United States Patent [19]

Ackeret

[11] 4,083,108

[45] Apr. 11, 1978

[54] DEVICE FOR HALVING FRUIT

[75] Inventor: Peter Ackeret, Kusnacht, Switzerland

[73] Assignee: Ackeret Design Studios, Ebmatingen, Switzerland

[21] Appl. No.: 730,199

[22] Filed: Oct. 6, 1976

[30] Foreign Application Priority Data

Aug. 6, 1976 Germany ..... 2635578

[51] Int. Cl.[2] ..... B26B 11/00

[52] U.S. Cl. ..... 30/124; 30/114

[58] Field of Search ..... 30/114, 124, 136.5, 30/290

[56] References Cited

U.S. PATENT DOCUMENTS

| | | | |
|---|---|---|---|
| 909,145 | 1/1909 | Brunson | 30/124 X |
| 1,541,624 | 6/1925 | Chute | 30/290 |
| 2,810,416 | 10/1957 | Russell | 30/124 X |
| 2,824,588 | 2/1958 | Lyon | 30/114 |

*Primary Examiner*—Jimmy C. Peters

*Attorney, Agent, or Firm*—H. Dale Palmatier

[57] ABSTRACT

A citrus fruit halving device comprising a holder and blade both of plastic and formed integrally and of one piece with each other, the blade having a sawtooth upper edge disposed adjacent the upper portions of the side walls of the holder, the holder forming a juice-confining chamber at its bottom and having enlarged and generally circular recesses in the side walls, adequate in size to receive the citrus fruits when thrust downwardly over the blade with a slight rotation to halve the fruit, the recess having a depth below the top edge of the blade nearly as deep as the diameter of the fruit so that the fruit may be halved in one downward thrusting motion with slight rotation.

16 Claims, 4 Drawing Figures

DEVICE FOR HALVING FRUIT

This invention relates to a device for the halving of fruit, especially citrus fruits from which the juice is to be extracted.

Fruit, such as lemons, oranges, and grapefruits from which the juice is to be extracted, are normally halved transversely to the axis of the fruit, after which the juice is squeezed out on a juice squeezer. A knife is used prior to this process for halving the fruit.

The use of the knife has a great number of disadvantages. During the cutting process juice necessarily flows out, and is lost and in addition the base, on which the cutting is carried out, as well as the hand of the user holding the fruit, becomes splashed. Some skill is required to hold fruit which is round, and children in particular may injure themselves.

It is the aim of the invention to provide a device for halving fruit which has a high degree of safety and can be used with little risk of splashing at the separation point. An addition aim is to make such a device which is cheap to manufacture.

This problem is solved according to the invention by a holder in which a cutting edge is so arranged that it can penetrate into the piece of fruit at least to half the diameter of the fruit, and in which the piece of fruit to be halved may be held during the entire halving process with both hands in the desired position without changing hands. The cutting edge is therefore no longer moved, as previously, relative to the piece of fruit held stationary by hand. The piece of fruit is so picked up with both hands, and moved over the cutting blade during the entire halving process, that the resulting halves need no longer be laid down at all and then picked up again; but can be squeezed immediately, advantageously both halves at the same time. The holder need only make the cutting blade accessible to the extent that it cuts halfway into a fruit of maximum size, since without letting it go the piece of fruit may also be halved by rotating it. The juice released during this touches neither the hands nor the outside of the skin of the fruit and may be collected in the holder which may have a juice-collecting chamber.

The cutting edge is in the simplest case a knife blade, but a string may also be used.

Advantageously, the device may have a juice-collecting chamber, a support for the two fruit halves, and a guide path for the movement of the fruit relative to the holder. At this juncture it should be mentioned that the holder may be a part of a fruit squeezer also with which the juice is extracted from the halves of the piece of fruit after it has been divided.

Figure 1:
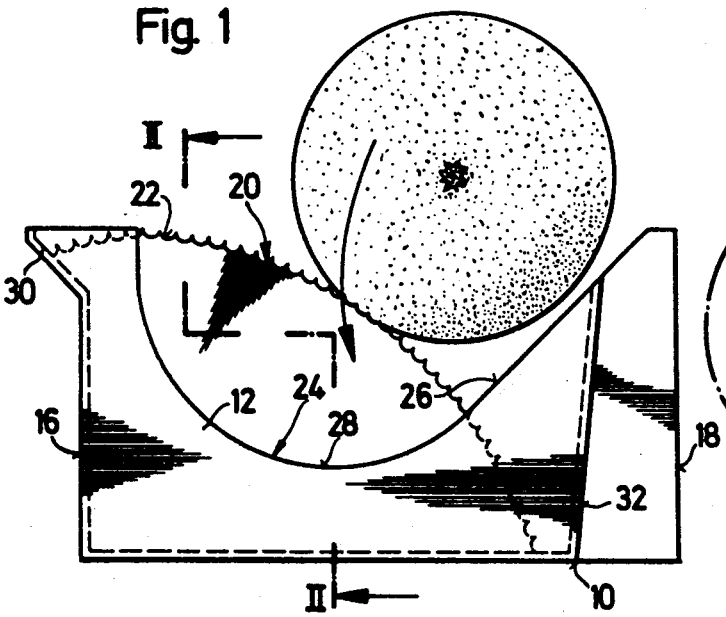
Figure 2:
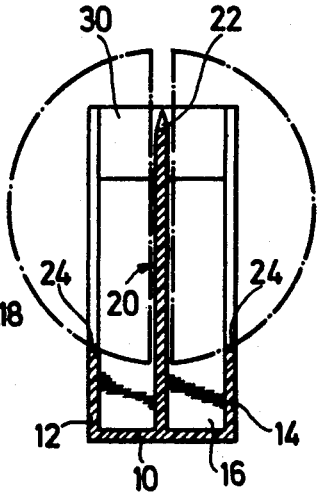
Figure 3:
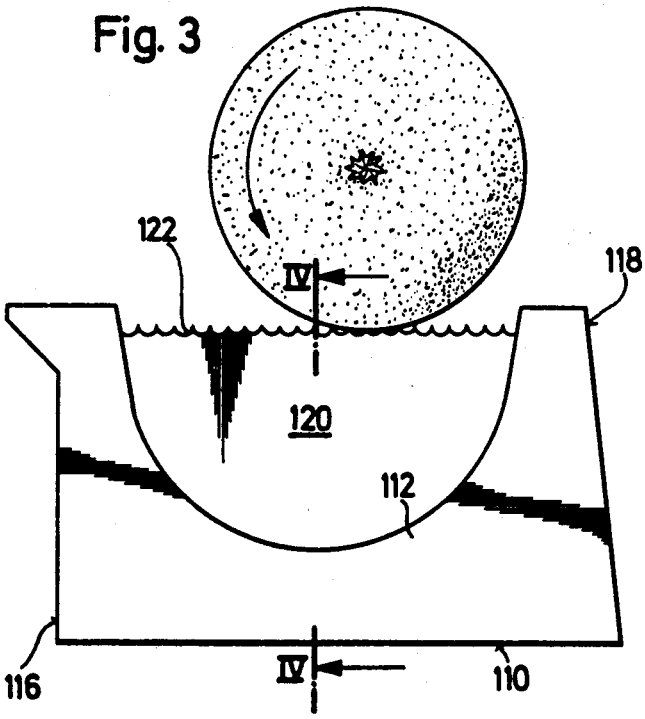
Figure 4:
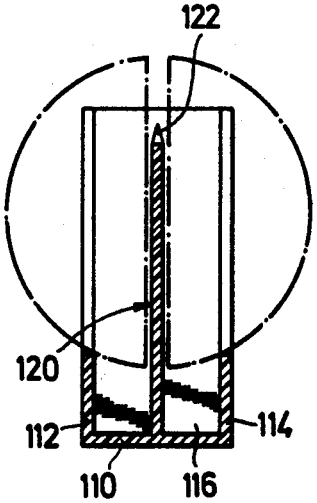

Two embodiments of a device for halving fruit, each constructed in accordance with the invention, will now be described, by way of example, with reference to the accompanying drawings, in which:

FIGS. 1 and 2 show in side elevation and in section along line II—II respectively, the first embodiment; and FIGS. 3 and 4 show in corresponding side elevation and in section along line IV—IV respectively, the second embodiment.

Referring to the drawings, FIGS. 1 and 2 show a device constructed in one piece as an injection-moulded part made of plastics material. The device includes a holder which comprises a base plate 10, two mirror-inverted, identical side walls 12 and 14, a front end wall 16 and a rear wall 18. The plane of a blade 20 provided with a cutting edge 22 runs parallel to the side walls 12 and 14 and is arranged centrally between these walls. The outline of the blade 20 corresponds to approximately a quarter circle, the blade along the radial edges being injection-moulded onto the base plate 10 or onto the front end wall 16. The exposed peripheral edge of the blade 20 is provided with a plain cylindrical grinding as the cutting edge 22.

Near the end walls 16 and 18, the side walls 12 and 14 are as high as the end walls, whereas in the intermediate area they have cutaway portions 24. These cutaway portions have three functions. Firstly, they give lateral access to the blade 20. Secondly, the piece of fruit to be halved may be supported and guided along the section 26 of the edge running upwards at an angle, and finally, the halves of the fruit can be put down after being halved in the lower, approximately semicircular, area 28 of the edge of the cutaway portion 24, the cut faces lying against the side faces of the blade 20.

The space around the lowest part of the blade 20 is surrounded by the end and side walls 16, 18 and 12, 14, and catches the juice released during the cutting process and running down the blade. This juice, which is lost when using a knife in the conventional manner, can amount to a considerable quantity, especially in the case of very ripe fruits, so that the device is advantageously provided with a pouring lip 30 near to the upper edge of the front end wall 16. The shaping of a handle or the like, indicated by the groove 32, may facilitate manipulation when pouring out the juice. The base plate 10 may be provided with a non-slip coating to improve the resistance of the device to slipping when on a smooth base.

FIGS. 3 and 4 show the second embodiment. Here too, the holder consists of a base plate 110, side walls 112 and 114, a front end wall 116 and a rear end wall 118. Varying from the first embodiment, the blade 120 is here approximately rectangular with a horizontal cutting edge 122, which has a cylindrical grinding or a saw-like grinding. Since this device too is a one-piece injection-moulded plastics part, the serration of the cutting edge 122 is not ground but worked in when the part is still in the jet mould. Alternatively, edge 122 may be a tensioned wire made of stainless steel and fastened at walls 116, 118.

The cutaway portions 124 of the side walls 112 and 114 are here almost exactly semicircular, since in this embodiment a guide means for the pieces of fruit is not necessary. Here too, it is of course possible to support the cut halves of the fruit.

To increase the stability, the base plate 110 is somewhat larger than the cross-section of the holder at the level of the cutting edge 122, so that the end walls 116, 118 and/or the side walls 112, 114, converge upwards, this being clearly recognisable in FIG. 3 only for the rear end face 118.

In both embodiments, the fruit can be halved by rotating it should the blade 20 or 120 be too samll to cut completely through the fruit by a mere pressing down operation.

What we claim is:

1. A device for halving citrus fruits such as oranges and the like from which the juice is to be extracted, the device comprising a holder having a bottom member adapted to rest upon a supporting surface, the holder having upstanding walls around the periphery of the bottom member, said walls including two upright end walls opposite each other and two side walls opposite each other and adjoining the end walls, an upright blade between the side walls and having an upper cutting edge, the blade being supported on the bottom member and widely spaced from the side walls and the blade being connected to at least one of the end walls, the side walls having upper edges with enlarged fruit-receiving recesses therein such that the edge of the blade and the adjacent portions of the upper edges of the wall extend transversely of each other, the lowermost portions of the upper edges of the side walls in said recesses being spaced significantly below the cutting edge of the blade by a distance nearly as great as the diameter of the citrus fruit so that the blade can penetrate into and halve the piece of fruit as the fruit is thrust downwardly with limited rotation, and said lowermost portions of the upper edges of the side walls also being widely spaced outwardly of the blade and also spaced above the bottom member whereby the piece of fruit to be halved may be held during the entire halving process with both hands and without changing hands.

2. A device as claimed in claim 1 wherein the side and end walls of the holder define a juice collecting chamber for juice escaping during the halving process.

3. A device as claimed in claim 2, wherein the juice-collecting chamber has a pouring lip and the holder is provided with a handle.

4. A device as claimed in claim 2, wherein the lowermost portions of the side wall upper edges are above the juice-collecting chamber.

5. A device as claimed in claim 1, wherein the holder has a guide path for the movement of the piece of fruit transversely to the cutting edge.

6. A device as claimed in claim 1, wherein the knife blade is perpendicularly upright.

7. A device as claimed in claim 6, wherein the knife blade consists of plastics material.

8. A device as claimed in claim 7, wherein the holder and blade is a one-piece injection-moulded plastics part.

9. A device as claimed in claim 1, wherein the blade is connected to both end walls.

10. A device as claimed in claim 1 wherein the holder is constructed like an open-topped box with end walls of approximately the same hight as the cutting edge.

11. A device as claimed in claim 1, wherein the cutting edge runs approximately horizontally parallel to the base surface of the holder.

12. A device as claimed in claim 1, wherein the cutting edge has approximately the shape of a quarter circle.

13. A device as claimed in claim 10, wherein the recesses in the side walls are approximately semi-circular in shape.

14. A device as claimed in claim 10, wherein one opposite pair of walls, starting from the base member of the holder, converge upwards.

15. A device as claimed in claim 6, wherein the knife blade has a saw-tooth grinding.

16. A device for halving citrus fruits such as oranges and the like from which the juice is to be extracted, the device comprising, a holder and a blade integral of each other and in one piece of plastic material, the holder having a bottom member adapted to rest upon a supporting surface, and also having upstanding walls around the periphery of the bottom member and including two upright end walls opposite each other and two upright side walls adjoining the end walls and in widely spaced relation and opposite each other to cooperate with said end walls in defining a juice-collecting chamber at the bottom of the holder, the two side walls having upper edges with enlarged fruit-receiving recesses therein with a depth of the same order of magnitude as the diameter of the citrus fruit, and said recesses being substantially semi-circular in shape, the lowermost portions of the upper edges of the side walls in said recesses being spaced above said bottom member to provide for significant storage space in the juice-collecting chamber, one of said end walls defining a pouring lip over which the juices stored in said chamber may be directed, one opposite pair of walls being oriented convergently upwardly, the upright blade being substantially perpendicular to the bottom member and having a sawtooth top cutting edge extending substantially parallel to the bottom member and extending substantially linearly between the upper portions of the opposite end walls, the blade being in widely spaced relation with each of the side walls and having said cutting edge being spaced above the lowermost portions of the upper edges of the side walls in the recesses by a distance nearly as great as the diameter of the citrus fruit so that the blade can penetrate into and halve the piece of fruit as the fruit is thrust downwardly with limited rotation along the blade and into said side wall recesses, whereby the piece of fruit to be halved may be held during the entire halving process with both hands and without changing hands.

* * * * *